United States Patent [19]

Marega

[11] Patent Number: 5,036,605

[45] Date of Patent: Aug. 6, 1991

[54] INCLINATION ADJUSTMENT DEVICE FOR SKI BOOTS

[75] Inventor: Antonello Marega, Montebelluna, Italy

[73] Assignee: Calzaturificio Tecnica Spa, Treviso, Italy

[21] Appl. No.: 438,063

[22] Filed: Nov. 20, 1989

[30] Foreign Application Priority Data

Nov. 28, 1988 [IT] Italy ..... 22214/88[U]

[51] Int. Cl.[5] ..... A43B 5/04

[52] U.S. Cl. ..... 36/121; 36/120; 36/117

[58] Field of Search ..... 36/117–121

[56] References Cited

U.S. PATENT DOCUMENTS

| | | | |
|---|---|---|---|
| 4,245,410 | 1/1981 | Moliter | 36/117 |
| 4,523,395 | 6/1985 | Borsoi | 36/119 |
| 4,546,558 | 10/1985 | Perini | 36/120 |
| 4,599,813 | 7/1986 | Sartor | 36/120 X |
| 4,669,203 | 6/1987 | Sartor | 36/120 |
| 4,882,857 | 11/1989 | Sartor et al. | 36/121 X |
| 4,962,594 | 10/1990 | Marega et al. | 36/120 X |

FOREIGN PATENT DOCUMENTS

| | | | |
|---|---|---|---|
| 0073989 | 3/1983 | European Pat. Off. | 36/117 |
| 0284978 | 10/1988 | European Pat. Off. | 36/117 |
| 3504002 | 8/1986 | Fed. Rep. of Germany | 36/117 |
| 2561878 | 10/1985 | France | 36/117 |

*Primary Examiner*—Paul T. Sewell
*Assistant Examiner*—Ted Kavanaugh
*Attorney, Agent, or Firm*—Griffin Branigan & Butler

[57] ABSTRACT

In a ski boot comprising a rigid shell to the sides of which a leg portion is pivotally connected, a rear closing device is provided permitting the blocking position of the leg portion with respect to the shell to be adjusted, whereby the leg portion inclination is also adjusted.

6 Claims, 4 Drawing Sheets

INCLINATION ADJUSTMENT DEVICE FOR SKI BOOTS

The present invention relates to ski boots of the fore entry type and more specifically to improvements relating to the devices controlling the inclination of the leg portion with respect to the ski boot shell. Since a number of year the ski boots are manufacture from substantially rigid plastic materials and comprise a shell having a sole, to which a leg portion is pivotally connected. The foot of the user is introduced through the leg portion with entering an inner lining shoe, provided with a padding and placed within the shell.

This leg portion is normally vertically divided so as to permit the clamping thereof around the leg just above the ankle and to be widened and opened to allow for the foot introduction, with the clamping taking place by means of suitable buckles or hooks.

If the retractable part of the leg portion is the fore one, the introduction of the foot is rather difficult and, moreover, the inner lining shoe must be oversized with respect to the foot whereby the specific function of the rigid shell is partially rendered void.

In recent years, in order to make it easier to insert the foot and to improve the tight sealing with respect to the water and to the snow as well to improve the aerodynamic feature of the ski boot, there have been realized ski boots of the so called rear entry type. In this case it is the rear part of the leg portion which becomes retractable and an easier introduction of the foot within the inner shoe and thus within the ski boot is permitted.

In the ski boots of this type normally a clamping closure of the rear part of the leg portion, namely the retractable one, to the shell of the ski boot is provided; this closure however involving some problems.

Firstly if the closing device is very rugged and the closure is strongly tightened, actuating difficulties exist, especially of the quick type, since account must be taken of the fact that such an operation is carried out on the snow field and consequently at low temperatures and sometimes with the closing lever covered by snow and ice.

Another problem is that with this type of closing device the inclination of the leg portion with respect to the shell of the ski boot is fixed in one position and mainly the position of the rear abutment of the skier leg is fixed.

In the published European Patent Application No. 253.362 of the same Applicant a rear adjustable closing device for ski boots of the rear entry type is disclosed comprising a hook connected to the rear part of the leg portion, this hook, under the action of spring means, being permitted to engage a tooth or other engagement member, rigidly connected to the ski boot shell.

The hook is connected to an actuating and blocking lever, one arm of which is connected to an abutment pin, which engages a fixed abutment provided in the ski boot shell. The pin may be adjusted, as regards its projection from the said arm of the actuating lever, so as to determine the position in which the leg portion is blocked and thus its inclination with respect to the shell is fixed.

Obviously, whatever technological solution capable of making more reliable the operation of the above described devices, more rugged and resistant their structure and more advantageous the industrial production, is a nevertheless a target constantly sought for.

The present invention leads just to the achievement of such a purpose. To this end it consists in a fore entry ski boot of the type comprising a shell and a leg portion pivotally connected to the shell, said leg portion being divided by an essentially vertical plane in two halves or half-leg portions, respectively fore or rear, said ski boot being provided with an adjustment device for the inclination of the leg portion with respect to the shell, characterized by comprising a pin crosswise positioned with respect to the rear vertical center line of the leg portion, having the ends anchored to the leg portion so as to be able to rotate around its axis, to said pin there being combined, with a screw and nut screw connection, two blocks symmetrically positioned with respect to said center line and cooperating with elements of the shell to obtain the desired adjustment, said pin being moreover actuatable to rotate around its axis from control means.

More specifically the above blocks have lower inclined surfaces cooperating with corresponding inclined planes of a fixed abutment formed onto said shell, whereby the mutual approaching or removal of said blocks causes a corresponding displacement of their inclined planes along said abutment and consequently the rear abutment more or less raises the rear leg portion with respect to the shell, which, taking it into account the hinge constraint of the leg portion to the shell, provides a corresponding inclination of the rear leg portion.

The peculiar features and advantages of the present invention shall more clearly appear from the following detailed description referred to the enclosed drawings, wherein.

Figure 1:
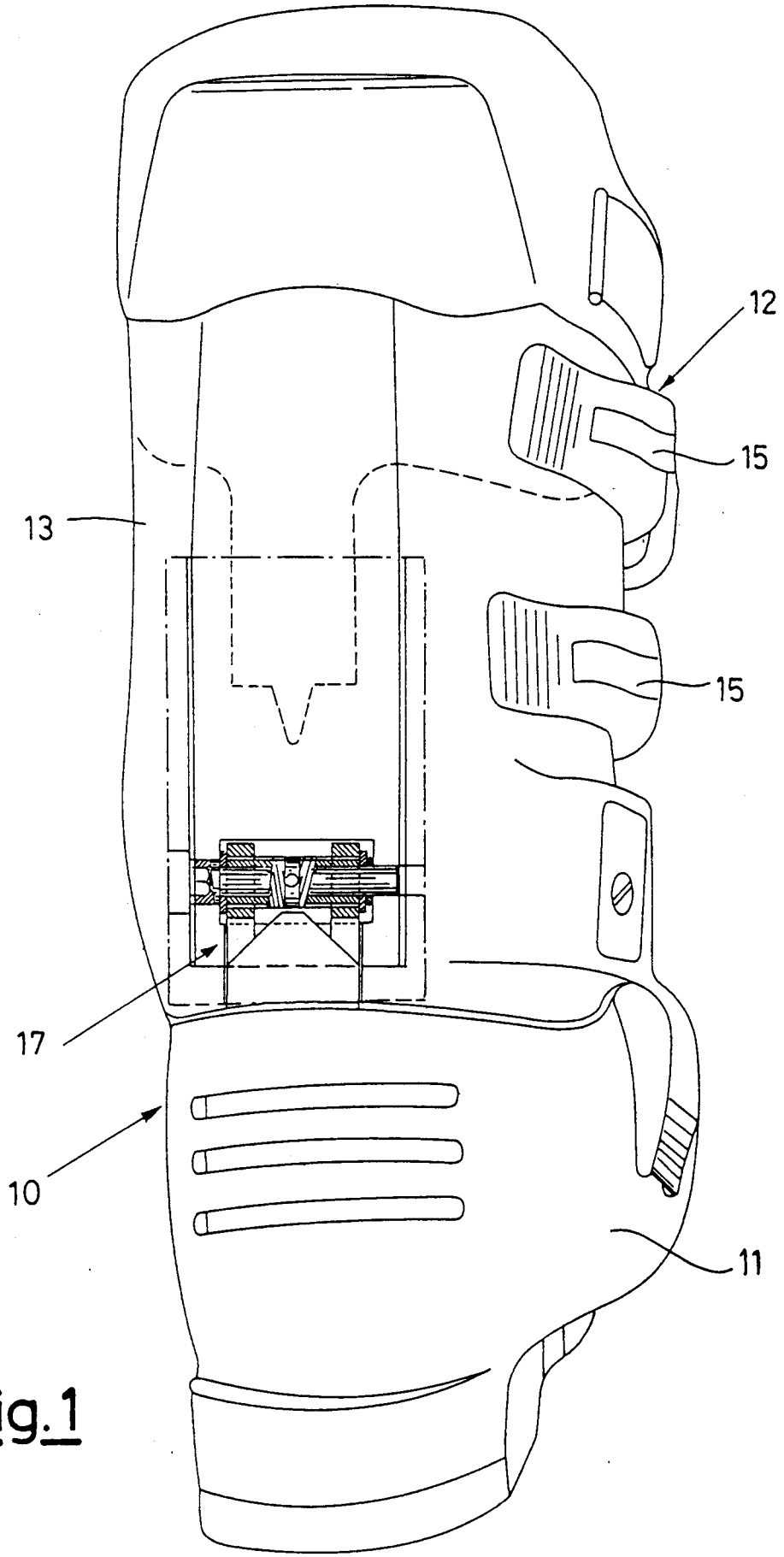
FIG. 1 is a perspective view of the preferred embodiment of the ski boot according to the present invention seen from the rear side.

Referring firstly to FIG. 1 a ski boot 10 is shown comprising a shell 11 and a leg portion 12 hinged to the shell in two horizontally aligned and opposed positions.

the leg portion as it is normal in the rear entry ski boots is divided into two half-leg portions, along a substantially vertical dividing plane, the rear half-leg portion 13 being capable of being clamped with respect to the fore one (not shown) by means of the standard blocking hooks 15.

Figure 2:
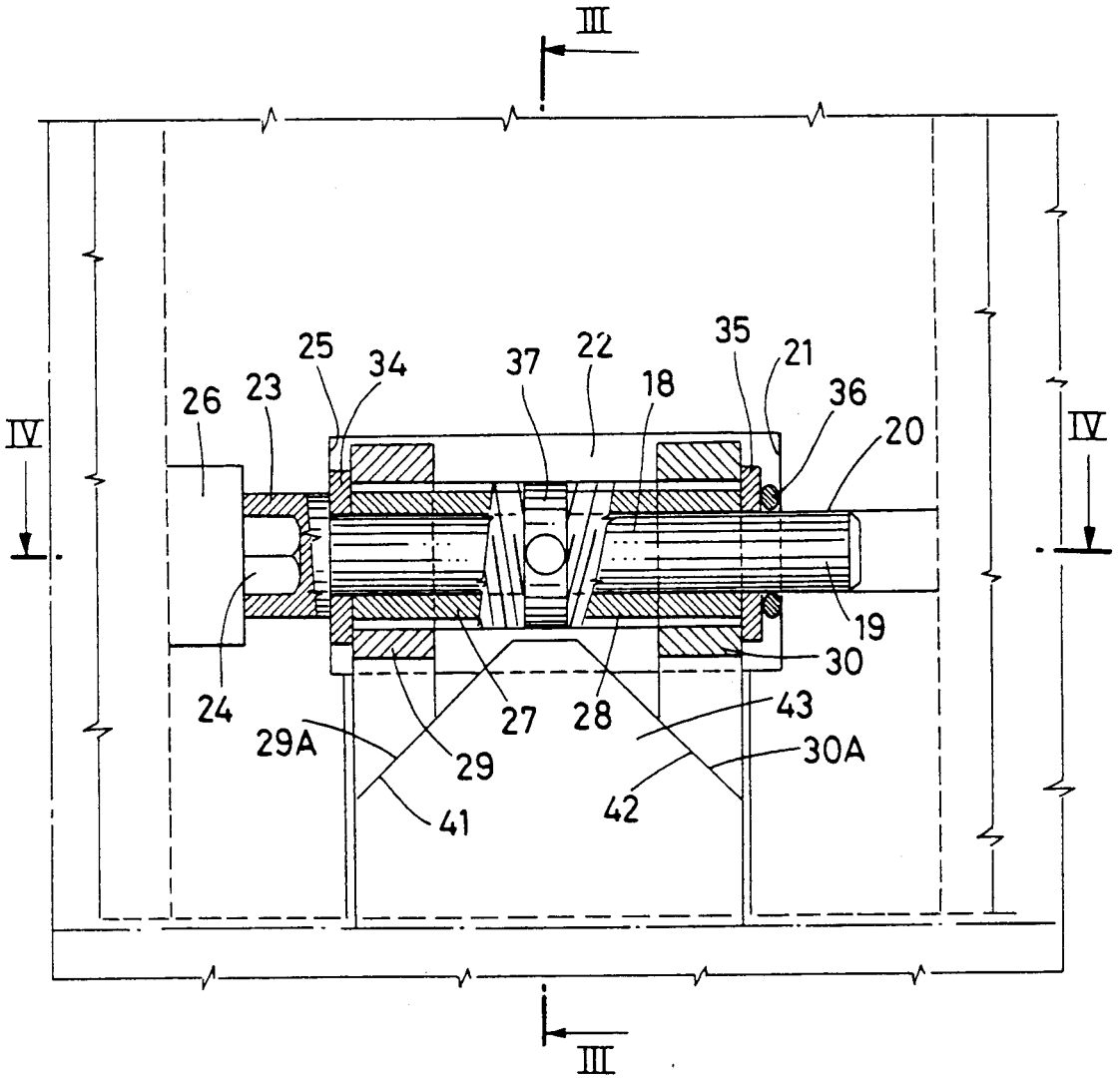
FIG. 2 is an enlarged scale view of the rear portion of the ski boot in which the adjustment device of the present invention, partially shown in cross section, is housed.
Figure 3:
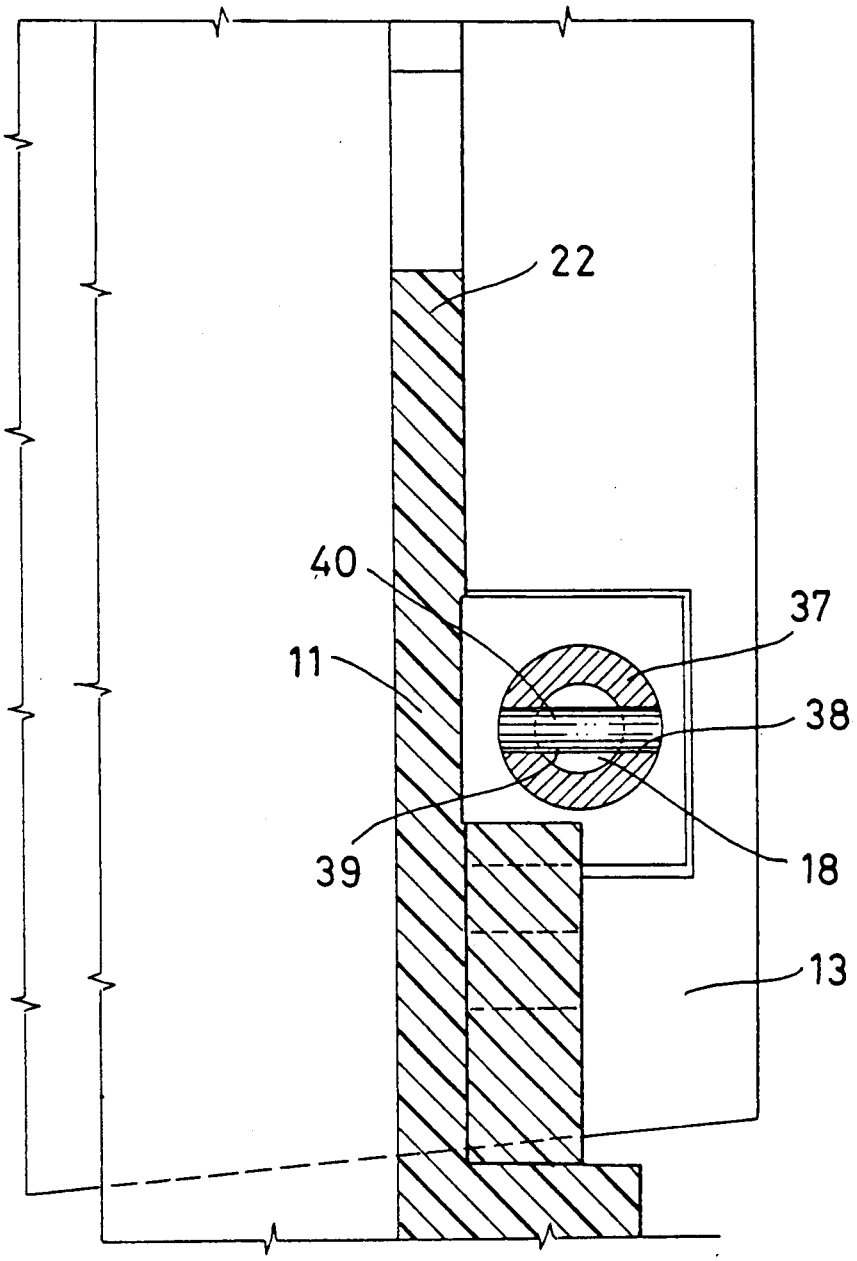
FIGS. 3 and 4 are cross section view respectively according to the lines III—III and IV—IV of FIG. 2.
Figure 4:
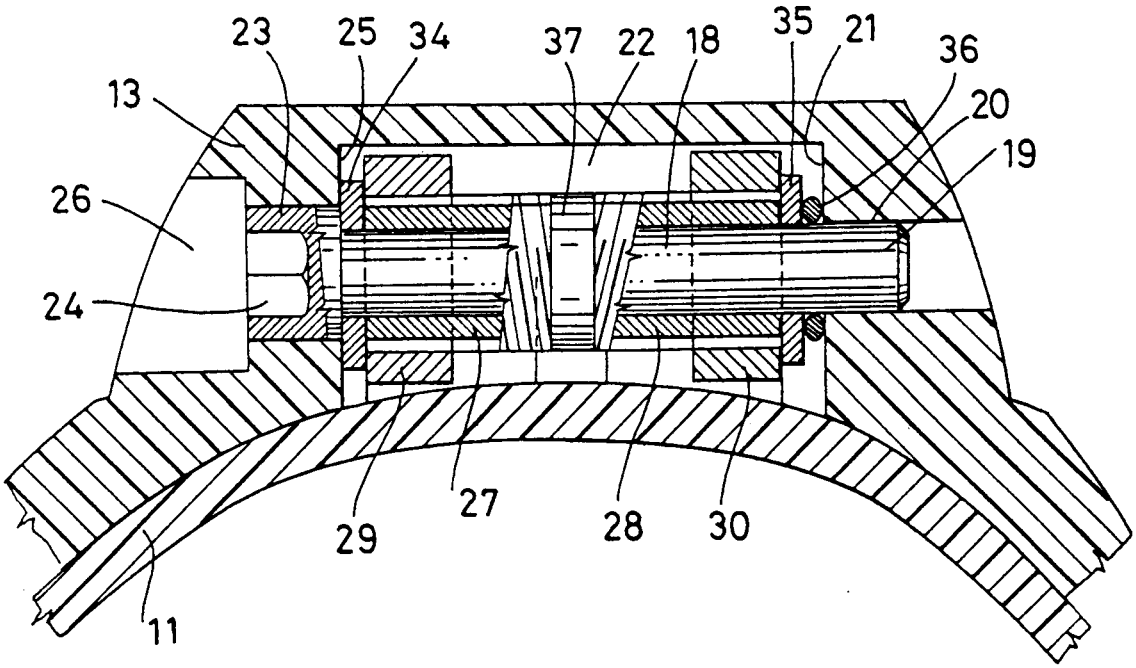

For the adjustment of the leg portion inclination with respect to the shell a device is provided, which is generically indicated with the reference 17. Referring now more specifically to the FIGS. 2, 3 and 4, said device 17 is detailed described.

It comprises a pin 18, having a first end 19 housed so as to be rotatable around its axis within a blind hole 20, formed within the shoulder 21 of a seat 22 provided in the thickness of the leg portion 13.

The other end 23 of the pin 18 is shaped with a cylindrical head in which a poligonal seat 24 is provided for the actuation by means of a socket wrench, the end 23 being housed within a hole provided in a shoulder 25 of a seat 22 opposed to the seat 21, said hole being into communication with the exterior through an enlarged part 26 for the access to the seat 24.

To the pin 18 two sleeves (27 and 28 respectively) are rigidly and symmetrically mounted, being externally provided with threads of opposite direction, on which two corresponding blocks 29 and 30 are engaged, each of them being provided with a through hole correspondingly threaded.

The two above said sleeves are abutting against the seat (respectively 25 for the sleeve 27 and 21 for the sleeve 28) through washers 34 and 35 whereas an elastic washer 36 is interposed between the washer 35 and the seat 21 to provide for the necessary recovery of possible tolerance.

In order to rigidly block the two sleeves 27 and 28 to the pin 18 a spacer 37 is provided, having a through hole 38, the latter is aligned with a diametrically through hole 39 of the pin 18 and a blocking pin or slit pin 40 is introduced in the holes 38 and 39.

It is understood that instead of the two sleeves and of the spacers only one sleeve can be provided which is rigidly clamped in a per se known manner to the axial pin and having two portions, symmetrical with respect to the vertical center line, threaded with thread of opposide directions.

The blocks 29 and 30 are cut in the lower part with inclined surfaces 29A and 30A cooperating by abutment with the inclined planes 41 and 42 formed on an abutment 43, formed on a one piece with the shell of the ski boot and shaped as inverted V.

The operation of the device 17 is as follows: By rotating the pin 18 by means of the socket wrench which, introduced through the opening 26, engages the seat 24, the two sleeves 27 and 28 being rotated together with the pin.

The respective opposite threads cause the two blocks 29 and 30 to be approached or removed from each other, keeping the symmetrical positioning with respect to the rear center line of the shell; consequently the two inclined surfaces 29A and 30A are compelled to slide onto the respective inclined planes 41 and 42 giving a stable abutment to the leg portion on the shell and, at the same time, determine an adjusted and desired inclination of the leg portion with respect to the ski boot shell. From the above considerations there are firstly shown the constructive simplicity and functionality of the device according to the present invention.

Another advantage important as well is that of the easiness and precision of adjustment, requiring only a socked wrench and permits the adjustment to be carried out on the ski field by the skier itself. The invention has been described with respect to a preferred embodiment, it being meant that modifications and variations conceptually and mechanically equivalent are possible and foreseable without falling out of its scope.

I claim:

1. In a front entry boot having a shell, a leg portion pivotally connected to the shell, with said leg portions being divided by a substantially vertical plane into a front half for foot entry into the boot and a rear half, the improvement comprising:

an adjustment device for adjusting and fixing the inclination of the rear half of the boot with respect to the shell wherein the adjusting and fixing device comprises:

(a) a cross pin disposed in a seat in the rear half and disposed generally perpendicularly to a vertical center line of the rear half, said pin having ends rotatably anchored in the rear half;

(b) a block disposed toward a first end of the pin and a block disposed toward an other end of the pin and both blocks being generally symmetrically disposed on said pin with respect to a vertical centerline of the pin;

(c) threads associated with said pin and threads associated with said blocks such that rotation of said pin in one direction moves the blocks toward each other and rotation of the pin in an opposite direction moves the blocks away from each other;

(d) a block inclined surface associated with each block;

(e) a plate operably connected to said shell at a rear portion thereof and having a plate inclined surface abutting each block inclined surface, said plate inclined surface being opposite in its inclination to the inclination of said block inclined surface; and (f) actuating means for causing rotation of said pin;

wherein rotation of said pin causes sliding of said block inclined surface on said plate inclined surface such that said rear half is inclined and fixed in that inclined position toward said front half upon rotation of said pin in one direction and said rear half is inclined and fixed in that inclined position away from said front half upon rotation of said pin in an opposite direction.

2. Ski boot according to claim 1, characterized in that said pin has rigidly connected sleeve means having external threads of opposite directions and each said block is provided with a threaded through hole, engaged with the external threads of the corresponding sleeve means.

3. Ski boot according to claim 1, characterized in that said actuating means comprise a head end of said pin having a shape for the engagement of a wrench, said rear half having a passage for the introduction of said wrench.

4. Ski boot according to claim 2, characterized in that said sleeve means comprise two sleeves separated by a spacer anchored to the pin.

5. Ski boot according to claim 4, characterized in that between at least one of said sleeves and an adjacent wall of said seat, spring means are provided for the tolerance recovery.

6. Ski boot according to claim 1, characterized in that said plate is a portion of said shell with two plate inclined surfaces formed by an abutment provided on said shell and shaped as an inverted V, and said blocks each have an inclined surface in abutment engagement with each of said plate inclined surfaces.

* * * * *